United States Patent [19]

Bucher

[11] Patent Number: 4,497,260

[45] Date of Patent: Feb. 5, 1985

[54] FLAT PALLET

[75] Inventor: Anton Bucher, Ennetbaden, Switzerland

[73] Assignee: Swiss Aluminium Ltd., Chippis, Switzerland

[21] Appl. No.: 417,062

[22] Filed: Sep. 13, 1982

[30] Foreign Application Priority Data

Sep. 23, 1981 [CH] Switzerland ..... 6119/81

[51] Int. Cl.[3] ..... B65D 19/26

[52] U.S. Cl. ..... 108/56.1; 108/56.3; 108/901; 52/731

[58] Field of Search ..... 108/56.1, 56.3, 51.1, 108/901, 902; 52/730, 731; 206/599, 600

[56] References Cited

U.S. PATENT DOCUMENTS 3,222,841 12/1965 Lipof ..... 52/731
3,312,034 4/1967 Steinmann ..... 52/731
3,878,796 4/1975 Morrison ..... 108/56.1
4,333,295 6/1982 Janke ..... 52/730

FOREIGN PATENT DOCUMENTS 43873 10/1966 Australia ..... 52/731

*Primary Examiner*—William E. Lyddane
*Assistant Examiner*—Peter R. Brown
*Attorney, Agent, or Firm*—Bachman and LaPointe

[57] ABSTRACT

Flat pallets made up to now out of extruded sections which are joined together, sometimes with additional ribbing for extra strength, have often exhibited disadvantages during assembly and when being repaired or having parts exchanged. The reason for this is that joining the parts together has up to now required a considerable amount of time and is expensive. To overcome these disadvantages, the cross beams and long beams of a pallet 10, made out of extrusions 12–22, are releasably and simply joined together by means of wedges 28.

3 Claims, 6 Drawing Figures

FLAT PALLET

BACKGROUND OF THE INVENTION

The invention relates to a flat pallet which is made up principally from extruded sections joined together, and in particular is used in applications concerning e.g. the foodstuff industry where the pallets have to meet relatively high demands with respect to hygiene standards.

Known flat pallets which have been used in the past for the above purpose are generally made up of extruded individual parts which are reinforced by ribbing and are joined together by boiling, rivetting and/or welding.

Large series production of such pallets has been expensive up to now partly because the joining of the individual parts was relatively time consuming. Also, only skilled workers could be employed for the welding of these pieces.

The object of the present invention is to develop a flat pallet of the above kind which can be made simply and economically i.e. without requiring skilled labor, at the same time avoiding the disadvantages associated with the previously mentioned, known pallets.

SUMMARY OF THE INVENTION

The foregoing object is achieved by way of the present invention wherein the long beams of the pallet, joined together by the cross beams, are each made out of individual parts joined together by wedges.

BRIEF DESCRIPTION OF THE DRAWINGS

Further advantageous embodiments of the invention are presented in the following description in connection with the drawings 1–6. The drawings show a simplified representation of an exemplified embodiment of the invention.

DETAILED DESCRIPTION

Figure 1:
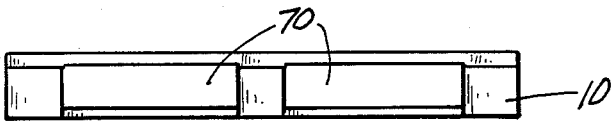
FIG. 1: A front view of the pallet.
Figure 3:
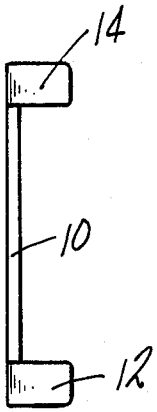
FIG. 3: An end view of the pallet.
Figure 2:
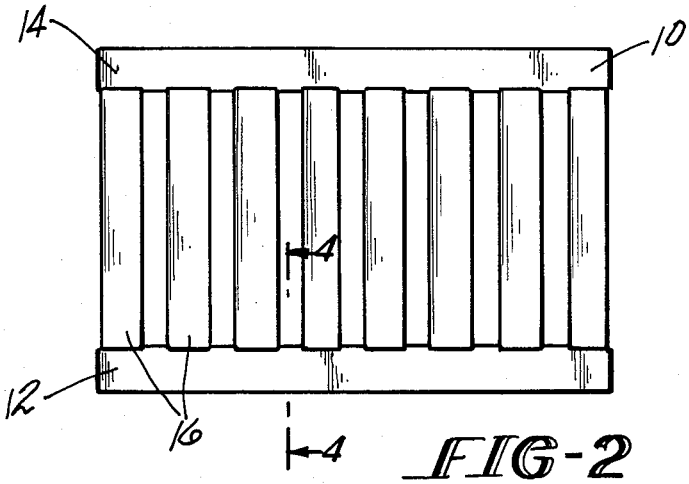
FIG. 2: A plan view of the pallet.
Figure 4:
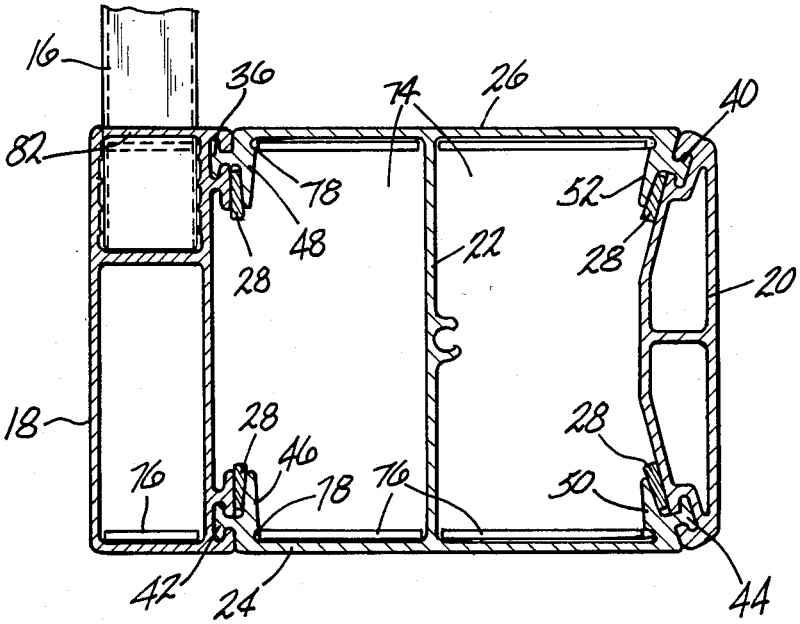
FIG. 4: A section through a long beam of the pallet along line IV—IV in FIG. 2, but on a larger scale than in FIG. 2.

The pallet shown in FIGS. 1–6 is made up essentially of two long beams 12 and 14 which, as seen in FIGS. 1–3, are joined by means of a plurality of cross beams 16.

Figure 5:
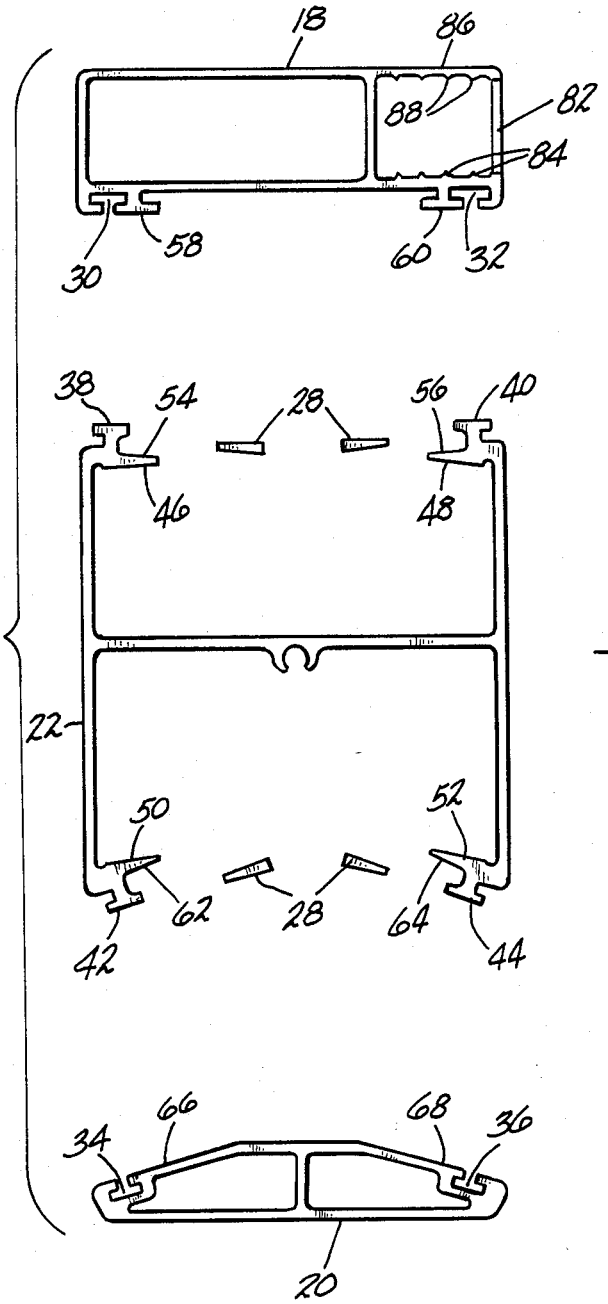
FIG. 5: An exploded view of the pallet showing the individual parts of it.
Figure 6:
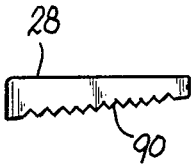
FIG. 6: A pallet wedge shown on a larger scale than in FIG. 5.

As shown in FIGS. 5 and 6, a long beam 12 or 14 is made up basically of an upper part 18, a lower part 20, an I-beam shaped part 22 with two sidewalls 24 and 26 and four wedges 28 by means of which the individual parts of the long beams 12 and 14 are held together.

The upper part 18 and the lower part 20 each feature at the sides an undercut groove 30, 32 or 34, 36 which runs along the length of both parts. Also, provided at the upper and lower ends of both sidewalls 24 and 26 of the I-beam shaped part 22 are T-shaped projections 38 and 40, and 42 and 44, which are pushed into the undercut grooves 30 and 32 of the upper part 18 and grooves 34 and 36 of the lower part 20 as the long beams are assembled. Further, close to the T-shaped projections 38 to 44, the I-beam shaped part 22 features nose-like projections 46, 48, 50, 52 which are such that the surfaces 54 and 56 form an acute angle with surfaces 58 and 60 respectively on the upper part 18, and surfaces 62 and 64 an acute angle with surfaces 66 and 68 respectively on the lower part 20 of the long beams 12 and 14, into which the wedge 28 can be pushed and clamped by the parts of the long beam.

The sidewalls 24 and 26 feature on each side openings 70 into which the lifting forks of a fork-lift truck can be inserted; these openings 70 also provide access to the wedges 28 during assembly or dismantling of the pallet. After the individual parts have been put together, plates 76 can be inserted on the inside of sidewalls 24 and 26 to cover over the openings 74 at the ends of the long beams 12 and 14.

Provided in the inner region of the upper and lower sidewalls 24, 26 are longitudinal grooves 78 and 80 each of which accommodates a plate 76 which can be pushed in from one end of the sidewall 24 and 26 towards the other end of the sidewall 24 and 26. The grooves are designed such that the plates 76 can hold themselves in place when the pallet 10 is in the working position.

The upper part 18 on each long beam 12 and 14 is provided on the inside with openings 82 into which cross beams 16 are inserted. In order to ensure good friction locking between the upper part 18 of the long beams 12 and 14 and the cross beams 16, a face with preferably longitudinal projections 84 is provided to engage with the cross beam 16. Likewise, longitudinal projections 88 are provided on the lower face of the upper wall 86 of the upper part 18.

As shown in FIG. 6, wedge 28 features, at least on one side, grooves 90 which run in the same direction and by means of which the wedge 28, when inserted between surfaces 54 to 68 of part 22 on the one hand and parts 18 and 20 on the other hand, achieves good engagement to prevent it slipping out of place. The wedges 28 can, if desired, also feature grooves on both sides.

The flat pallet is economic to manufacture and can be repaired simply and swiftly as its individual parts can be readily exchanged due to the wedge type locking of the parts.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A flat pallet for use in the foodstuff industry wherein a high standard of hygiene is desired comprising a pair of substantially parallel long beams joined together by at least one cross beam, each of said long beams having a central substantially I-shaped beam portion connecting an upper portion and a lower member, said substantially I-shaped beam portion comprising a central portion connecting two arm portions wherein said arm portions are provided on the ends thereof with T-shaped projections adapted to be engaged with undercut grooves provided on said upper member and said lower member so as to secure said upper member and said lower member to said substantially I-shaped beam portion and further including a plurality of wedges provided between said arm portions and said upper member and said lower member for insuring good engagement between said first securing means and said second securing means.

2. A flat pallet according to claim 1 wherein said upper member is in the form of a hollow section.

3. A flat pallet according to claim 1 wherein said lower member is in the form of a hollow section.

* * * * *